United States Patent [19]

Koguchi et al.

[11] Patent Number: 4,913,676

[45] Date of Patent: Apr. 3, 1990

[54] MOVING ANIMAL TOY

[75] Inventors: Noriyuki Koguchi, Saitama; Takashi Furuya, Tokyo, both of Japan

[73] Assignee: Iwaya Corporation, Tokyo, Japan

[21] Appl. No.: 172,251

[22] Filed: Mar. 23, 1988

[30] Foreign Application Priority Data

Oct. 20, 1987 [JP] Japan ..... 62-265060

[51] Int. Cl.[4] ..... A63H 13/00

[52] U.S. Cl. ..... 446/300; 446/330; 446/353

[58] Field of Search ..... 446/300, 301, 330, 338, 446/353, 356; 40/414, 416

[56] References Cited

U.S. PATENT DOCUMENTS

| | | | |
|---|---|---|---|
| 712,595 | 11/1902 | Reutlinger et al. | 40/416 X |
| 2,158,860 | 5/1939 | Hype | 446/353 |
| 2,953,869 | 11/1960 | Collischan | 446/300 X |
| 3,131,497 | 5/1964 | Rogers | 40/416 X |
| 3,153,871 | 10/1964 | Semba | 40/416 |
| 3,443,338 | 5/1969 | Collins | 446/300 X |
| 3,911,613 | 10/1975 | Morrison et al. | 446/338 |
| 3,964,205 | 6/1976 | Kuramochi | 446/338 |
| 4,389,811 | 6/1983 | Iwaya et al. . | |

FOREIGN PATENT DOCUMENTS

| | | | |
|---|---|---|---|
| 248115 | 12/1987 | European Pat. Off. | 446/300 |

*Primary Examiner*—Robert A. Hafer
*Assistant Examiner*—Sam Rimell
*Attorney, Agent, or Firm*—James E. Nilles

[57] ABSTRACT

A moving animal toy wherein when a motor is started upper and lower beaks are pivoted up and down simultaneously to widely open and close its beaks, and at the same time a head is slowly rotated twisting its head sideways. When a voice is uttered against the toy, it is received through a microphone by a voice recording and reproducing device and after a specified recording time elapses, the voice is reproduced by the speaker.

6 Claims, 8 Drawing Sheets

FIG. 6
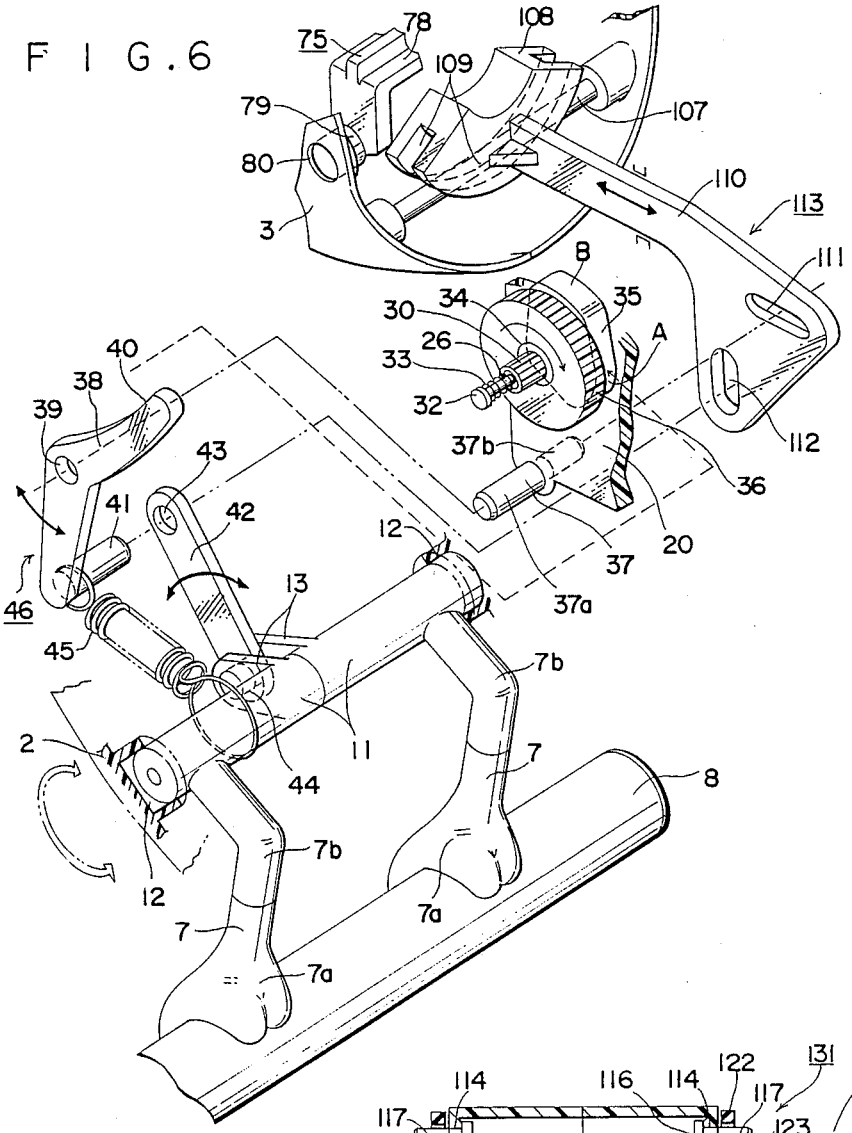
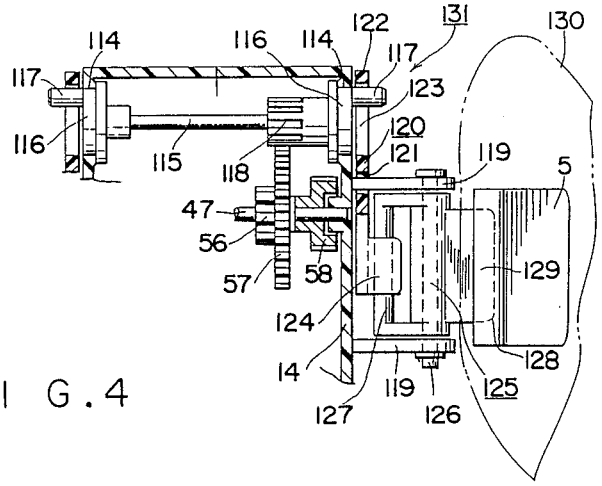
FIG. 4

MOVING ANIMAL TOY

BACKGROUND OF THE INVENTION

1. Field of the Invention

The present invention relates to a moving animal toy and more particularly to a moving animal toy which is shaped like a bird such as a parrot and which is made to perform desired actions characteristic of that animal.

2. Description of the Prior Art

There are many kinds of moving toys which are made to look like birds such as parrots. Many of these toys have the structure in which the lower beak is pivoted up and down with respect to the upper beak; the head is vertically pivoted as if it picked its feed; and the body is pivoted back and forth independently of the head motion.

In the toy birds with the above structure, since the upper beak is not pivoted, the beak opening action is small. For the toy birds such as parrot toys that mimick human voices, this small beak motion is monotonous and poor in expression and may provide little attraction to a player. Since the head is pivoted only in the vertical direction, its action is too simple, rigid and unnatural to amuse the user.

Also the motion of the body has similar problems to those of the head. In addition to the lack of expression because of monotonous motions of the beak and the head, the conventional toys have the disadvantage that they cannot respond to the player. For the bird toys such as parrot toys that mimick human voices, these simple motions cannot amuse the player.

SUMMARY OF THE INVENTION

A primary object of this invention is to provide an interesting moving animal toy which opens its beak widely and performs smooth and natural head actions to make the toy motion as realistic as possible and thereby make the toy interesting and amusing.

Another object of this invention is to provide an interesting moving animal toy which, in combination with a variety of actions, reproduces the voice uttered by the player as if the toy were mimicking the player's words.

The first objective is achieved by a moving animal toy which comprises: a body frame; a head frame mounted to the body frame through a rotatable interlocking rod, the head frame having upper and lower beaks mounted in a beak opening formed in the head frame in such a way that the beaks are vertically pivotable on support shafts; a beak actuating mechanism that is provided in the head frame to open and close the upper and lower beaks simultaneously; a head turning mechanism which is driven by a motor installed in the body frame to rotate the head frame clockwise and counterclockwise alternately about the interlocking rod; and a vertical head actuating mechanism which is driven by the motor to pivot the head frame up and down about a support shaft.

The second objective is achieved by a moving animal toy which comprises: a body frame supported on a pair of legs in such a manner that it is pivotable back and forth; a head frame mounted to the body frame through a rotatable interlocking rod, the head frame having upper and lower beaks mounted in a beak opening formed in the head frame in such a way that the beaks are vertically pivotable on support shafts; a beak actuating mechanism installed in the head frame to open and close the upper and lower beaks simultaneously; a head turning mechanism which is driven by a motor installed in the body frame to rotate the head frame clockwise and counterclockwise alternately about the interlocking rod; a vertical head actuating mechanism which is driven by the motor to pivot the head frame up and down about a support shaft; a body pivoting mechanism which is driven by the motor to pivot the body frame back and forth with respect to the pair of legs; and a voice recording and reproducing device installed in the body frame, the device having a microphone and a speaker spaced from each other in the body frame, the device being adapted to record a voice entered from the microphone and then reproduce the recorded voice and at the same time start the motor.

As to the moving animal toy according to the first invention, when the beak actuating mechanism is operated by starting the motor, the upper and lower beaks are pivoted up and down simultaneously about the support shafts to widely open and close its beaks. The motor also drives the head turning mechanism and the vertical head actuating mechanism almost at the same time so that the head is slowly turned clockwise and counterclockwise alternately by the head turning mechanism while at the same time it is slowly pivoted up and down by the vertical head actuating mechanism. The combined action of the head turning mechanism and the vertical head actuating mechanism causes the head to slowly rotate twisting its head sideways. Also, the beaks are widely opened and closed while the head is turned to look sideways.

As to the moving animal toy according to the second invention, when the main switch is turned on, the switch mechanism is energized. But as long as the microphone receives no voice, the motor is kept deenergized by the control action of the voice recording and reproducing device. Thus, the motor is in a standby condition ready to be started upon reception of a voice.

When a voice is uttered against the toy, it is received through the microphone to the voice recording circuit of the voice recording and reproducing device where it is recorded. After a specified recording time elapses, the voice reproducing circuit of the voice recording and reproducing device is energized and the motor is started. The voice reproduced by the voice reproducing circuit is output to the speaker from which it is sounded.

When the motor is started by a signal, the beak actuating mechanism is energized to pivot the upper and lower beaks up and down to widely open and close them. At the same time the body pivoting mechanism is actuated to slowly pivot the body back and forth with respect to the pair of legs. In addition, the head turning mechanism and the vertical head actuating mechanism are operated almost simultaneously so that the head frame is slowly turned clockwise and counterclockwise alternately by the head turning mechanism while it is pivoted slowly up and down by the vertical head actuating mechanism. The combined action of the head turning mechanism and the vertical head actuating mechanism causes the head frame to rotate twisting its neck sideways. As the motor is started by the voice recording and reproducing device, the toy slowly pivots the body frame back and forth, rotates the head frame clockwise and counterclockwise alternately, widely opens and closes the beaks, and also reproduces the recorded voice and sounds the voice from the speaker in synchronism with the beak opening and closing action.

With the elapse of a preset time duration, the voice reproducing circuit and the motor power circuit are automatically stopped by the control action of the voice recording and reproducing device.

These and other objects and features of this invention will be explained by referring to the attached drawings.

BRIEF DESCRIPTION OF THE DRAWINGS

The attached drawings show embodiments of the invention; in which

FIG. 4 is a cross section taken along the line IV—IV of FIG. 3;

FIG. 6 is a perspective exploded view showing a body pivoting mechanism and the head of the toy;

DESCRIPTION OF THE PREFERRED EMBODIMENT

Figure 1:
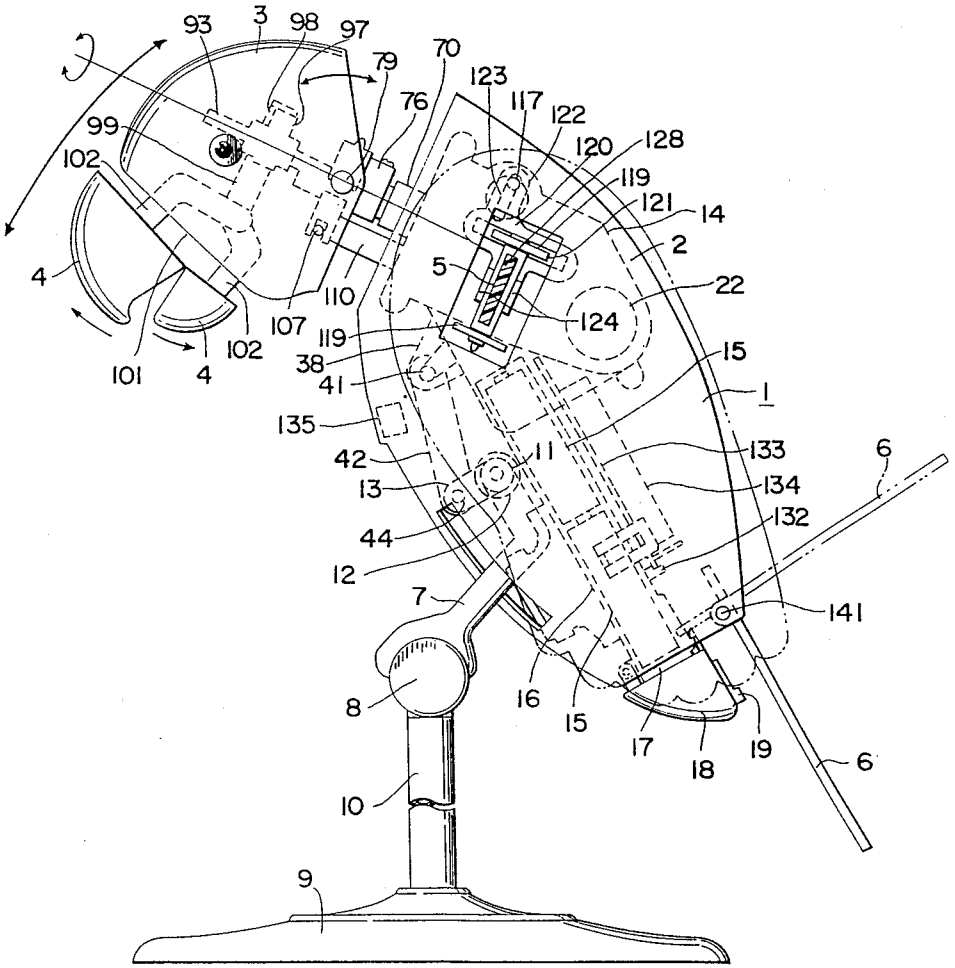
FIG. 1 is a side view of the moving animal toy of the invention.
Figure 2:
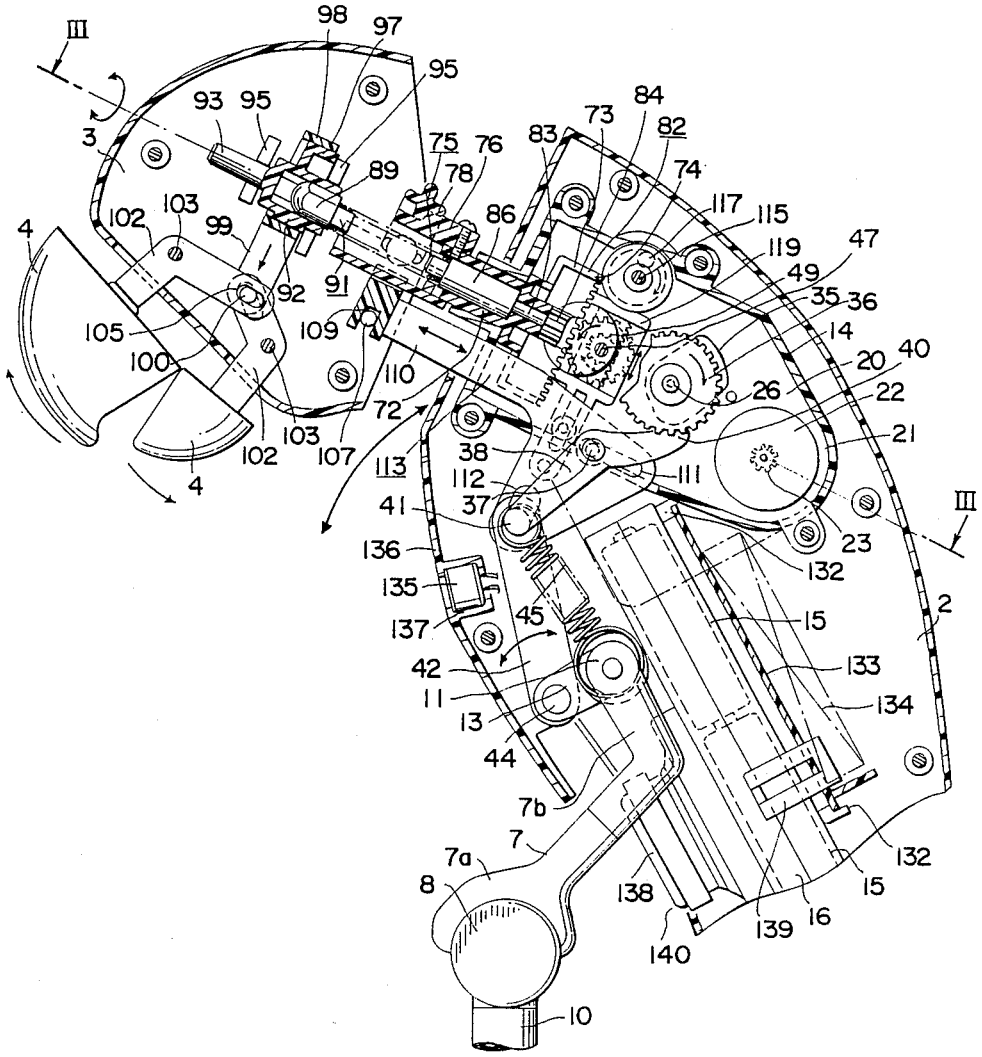
FIG. 2 is a side view of the toy showing its internal mechanism.
Figure 3:
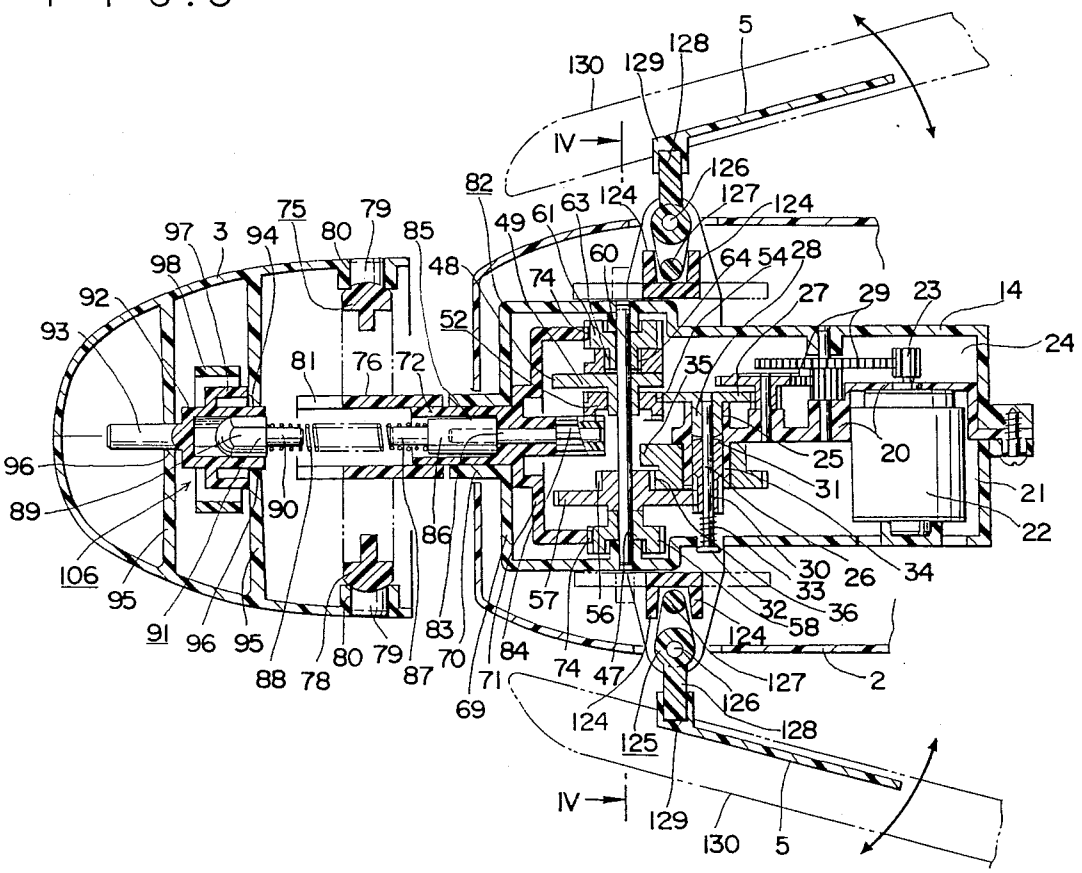
FIG. 3 is a cross section taken along the line III—III of FIG. 2.
Figure 5:
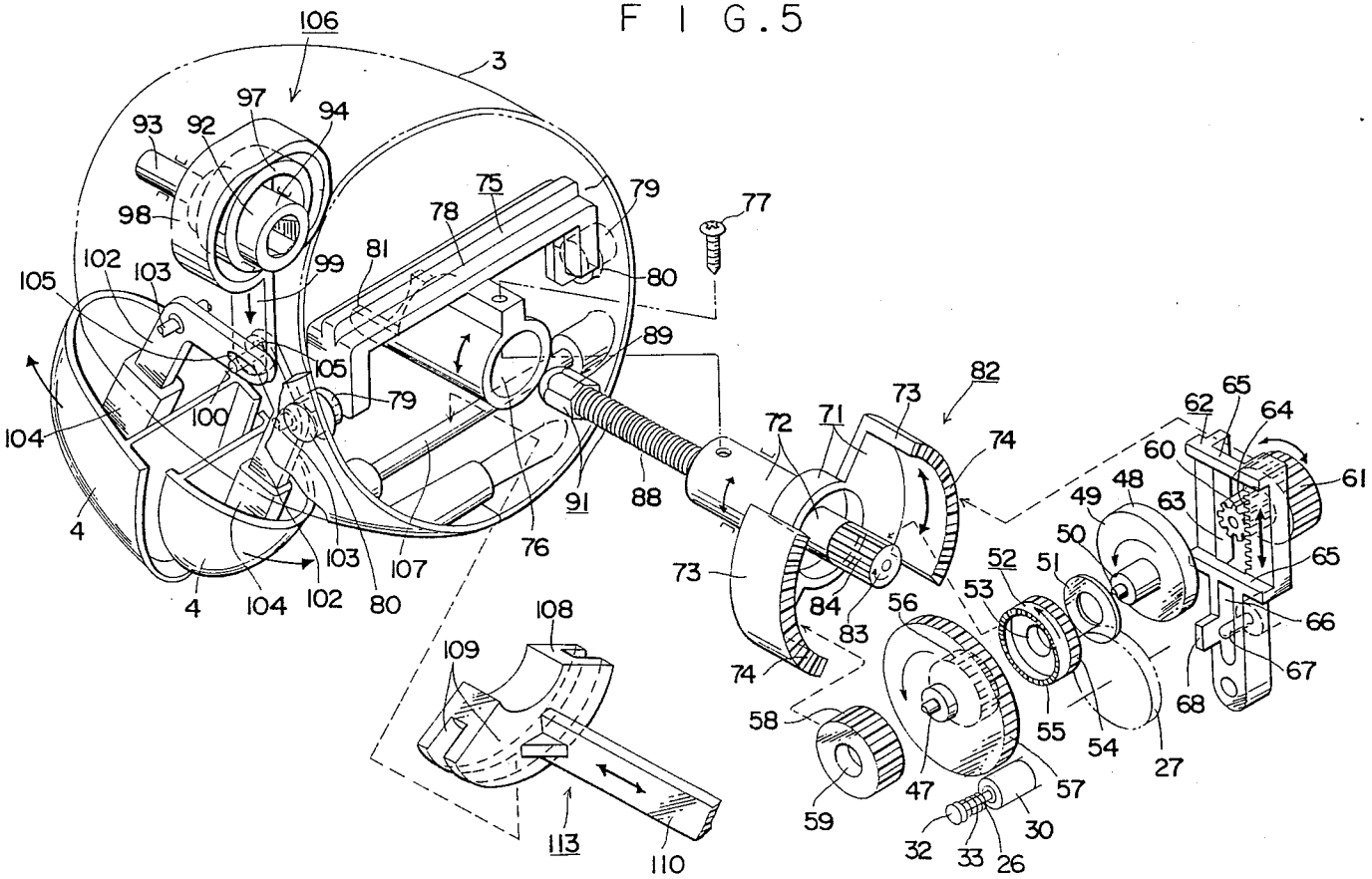
FIG. 5 is a perspective exploded view showing a beak actuating mechanism and the head of the toy.
Figure 7:
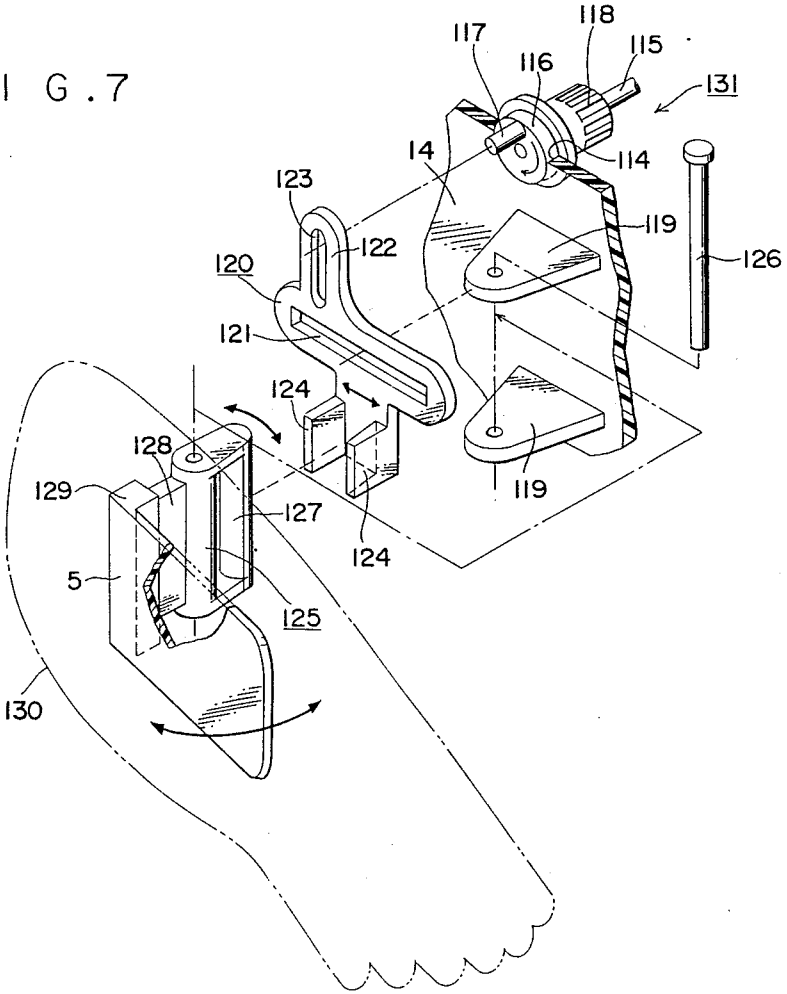
FIG. 7 is a perspective exploded view showing a wing actuating mechanism.

In the drawings, reference numeral 1 signifies a toy which is made to look like a bird. The toy 1 consists of a body frame 2, a head frame 3, a pair of upper and lower beaks 4 that can be opened or closed, a pair of wings 5, a tail frame 6, and a pair of legs 7. The legs 7 are secured to a perch 8 that extends laterally with respect to the toy bird and which is removably supported on the upper end of a stay 10 erected on a base 9.

The pair of legs 7 consist of feet **7*a* secured to the perch 8 and thighs 7*b* that are removably connected to the feet 7*a*. A cylindrical rod 11 that extends horizontally through the upper ends of the pair of thighs 7*b* is formed integrally with the thighs 7*b*. On both ends of the cylindrical rod 11 the lower intermediate portion of the body 2 is mounted rotatably back and forth through a pair of bearings 12. The rod 11 has mounting projections 13** at the central portion thereof.

The body 2 consists of left and right halves joined together that can be separated. Securely positioned at the front upper portion in the body 2 is a gear case 14, to the lower rear portion of which a battery case 16 containing batteries 15 is secured, extending toward the rear end of the body. The battery case 16 has an opening 17 at its rear end which is opened or closed by a cover 18 that is pivotably mounted on the rear end of the case 16. The cover 18 has a switch mechanism and on the upper surface a switch knob 19 that is made slidable to turn the switch mechanism on and off.

The gear case 14 consists of right and left halves joined together that can be separated. In the intermediate portion of the gear case 14 a partition plate 20 is securely placed. A motor 22 connected to the batteries 15 is securely installed in a chamber 21 which is formed in the gear case 14 at the rear side part by the partition plate 20. The motor 22 has its pinion 23 projecting into the other chamber 24 separated by the partition plate 20 in such a way that it is rotatable.

The partition plate 20 has a laterally extending bearing hole 25 formed at the front upper portion thereof in which a rotating shaft 26 is inserted. To the end of the rotating shaft 26 in the second chamber 24 of the gear case 14 a bearing boss 28 of an intermediate gear 27 is secured. The bearing boss 28 is rotatably inserted in the bearing hole 25. The intermediate gear 27 is in mesh with the pinion 23 of the motor 22 through a gear train 29 installed in the second chamber 24. In the first chamber 21 a pinion 30 is mounted rotatably and axially slidably on the other end of the rotating shaft 26. The pinion 30 is inserted rotatably and axially slidably in the bearing hole 25. The pinion 30 and the bearing boss 28 are disengageably coupled together at their internal ends through a clutch 31. Between the outer end of the pinion 30 and a stopper 32 at the projecting end of the rotating shaft 26 there is a coil spring 33 on the shaft 26 to urge the pinion 30 toward the intermediate gear 27 and thereby keep the pinion 30 and the gear 27 engaged through the clutch 31 at all times.

A bearing cylinder 34, circular in cross section, is formed around the circumference of the bearing hole 25 in which the pinion 30 is inserted. On the bearing cylinder 34 is rotatably mounted a cam drive gear 36 which has a cam 35 on one side. The cam 35 is formed nearly rectangular having a plurality of driving surfaces A, B, C.

A support shaft 37 is horizontally passed through the front lower part of the partition plate 20 and at its intermediate portion is secured to it. The support shaft 37 has a pivotable arm 38—which is bent like a boomerang—rotatably mounted on an external portion **37*a* thereof through an insertion hole 39 formed at the intermediate portion of the arm 38. The pivotable arm 38 has at its upper end an engagement portion 40 which is engaged with the cam 35. At its lower end the pivotable arm 38 has a horizontal support shaft 41 projecting therefrom, on which a support arm 42 is rotatably mounted at its front end through an insertion hole 43. The lower end of the support arm 42 is mounted vertically pivotably between the mounting projections 13 through a mounting shaft 44. Between the support shaft 41 of the pivotable arm 38 and the cylindrical rod 11 is stretched a coil spring 45 which urges the engagement portion 40 of the pivotable arm 38 to engage with the cam 35** at all times.

The cam 35, pivotable arm 38, support arm 42, coil spring 45, and the cylindrical rod 11 make up a body pivoting mechanism 46 which pivots the body frame 2 back and forth about the cylindrical rod 11.

A laterally extending drive shaft 47 is rotatably mounted on the sides of the gear case 14 at the front part. The drive shaft 47 has securely mounted to one of its end portions a cam disk 49 which has a cam 48 around its circumference. The cam disk 49 has a bearing boss 50 on which a cylindrical rotating member 52 is rotatably mounted through its insertion hole 53 and a washer 51. The rotating member 52 has formed on the circumference at one side an input gear 54 which is in mesh with the intermediate gear 27. The rotating member 52 also has an output gear 55 formed around the side wall periphery on the side of an opening. Secured to one end portion of the drive shaft 47 are a first interlocking gear 56 in mesh with the cam drive gear 36 and a second interlocking gear 57 in mesh with the pinion 30. On the outer side of the second interlocking gear 57, a guide gear 58 is rotatably mounted on the drive shaft 47 through an insertion hole 59. Rotatably mounted on the other end portion of the drive shaft 47 is a drive gear 61 that has a pinion 60 projecting inwardly. The pinion 60 of the drive gear 61 is inserted into an upper guide slot 63 which is formed vertically elongate in an interlocking frame 62. It is engaged with a rack 64 which is formed along one of the vertical edges of the upper guide slot 63. The interlocking frame 62 has at the upper and lower ends of the upper guide slot 63 a pair of parallel engagement projecting strips 65 with which the cam 48 of the cam disk 49 are engaged. Below the lower engagement projecting strip 65 is formed a lower guide slot 66 which is vertically elongate and in which a guide 67 projecting from the gear case 14 is inserted. The interlocking frame 62 also has a spacer 68 projecting from one side of the lower guide slot 66. As the cam disk 49 is turned, the interlocking frame 62 is moved up and down by the engagement between the cam 48 and the upper and lower engagement projecting strips 65. At the same time the pinion 60 is rotated by the rack 64 of the interlocking frame 62, causing the drive gear 61 formed integral with the pinion 60 to turn in the forward or reverse direction.

The gear case 14 has a guide cylinder 70 integrally formed at the intermediate portion of a front plate 69. In the guide cylinder 70 a bearing boss 72 of a rotating member 71 installed in the gear case 14 is rotatably inserted. At the rear of the bearing boss 72 is formed a pair of arc side plates 73, one on each side of the boss, which have crown gears 74 formed at their open end peripheries, the crown gears 74 being in mesh with the guide gear 58 and the drive gear 61, respectively. Sleeved over the front part of the bearing boss 72 of the rotating member 71 is a connecting cylinder 76 that extends longitudinally with respect to a support frame 75. The connecting cylinder 76 and the bearing boss 72 are secured together by a screw 77. A laterally extending frame 78 of the support frame 75 has support shafts 79 on each side which are rotatably inserted in bearing holes 80 formed in the intermediate portions of the head frame 3 of the toy bird on each side. The head 3 is rotatably supported on the support frame 75. The connecting cylinder 76 has a notched recess 81 formed at the front upper portion thereof. The cam disk 49, the interlocking frame 62 with the upper and lower engagement projecting strips 65 and the rack 64, the drive gear 61 with the pinion 60, the rotating member 71 with the crown gears 74, and the support frame 75 constitute a head turning mechanism 82 which turns the head 3 about an interlocking rod 91 clockwise and counterclockwise.

A rotating shaft 83 is rotatably inserted in the bearing boss 72 of the rotating member 71 and has an input gear 84 secured to its rear end portion and engaged with the output gear 55 of the rotating member 52. The bearing boss 72 has a hollow insertion recess 85 in the front portion thereof which is larger in diameter than the rotating shaft 83. The rotating shaft 83 projects into the insertion recess 85 in which a joint 86 is rotatably disposed and is secured to the front end of the shaft 83. The joint 86 has a spring support 87 to which the base end of a joint spring 88 is secured. The joint spring 88 at the front end is secured to a spring support 90 of a coupling member 89 which is polygonal in cross section. The rotating shaft 83, the input gear 84, the joint 86, the spring joint 88 and the coupling member 89 form the interlocking rod 91 which is rotatable in the bearing boss 72 and the connecting cylinder 76. The coupling member 89 of the interlocking rod 91 is engaged with a connecting cylinder 92 that has a polygonal inner wall cross section so that they are locked and turned together. The connecting cylinder 92 has a support shaft 93 at the front and a support section 94 at the rear and they are rotatably inserted through bearing holes 96 in front and rear mounting plates 95 of the head 3. The connecting cylinder 92 has an eccentric cam 97 integrally formed around its outer periphery. Further on the outer periphery of the cam 97 is loosely mounted a roughly circular interlocking ring 98, from one side of which an interlocking piece 99 is projected. The interlocking piece 99 has a connecting rod 100 which is secured at its intermediate portion to the free end of the interlocking piece 99. The head 3 has an opening 101 for the beak in which upper and lower L-shaped beak mounting members 102 are vertically pivotably supported at their intermediate portions on support shafts 103 which project from the head 3. The upper and lower beak mounting members 102 are secured at the lower ends to mounting sections 104 of the beaks 4. The beak mounting members 102 have slots 105 formed at the inner ends in which the connecting rod 100 is rotatably inserted at the inner and outer end portions.

The output gear 55, the input gear 84, the interlocking rod 91, the cam 97, the interlocking ring 98, and the beak mounting members 102 form a beak actuating mechanism 106 that opens and closes the upper and lower beaks 4.

In the rear lower part of the head 3 an interlocking lateral rod 107 is stretched horizontally across the interior of the head 3. An engagement sector 108 has an arc groove 109 which is engaged with the interlocking lateral rod 107. The engagement sector 108 is connected to the front end of a longitudinally moving piece 110 which has at the rear end a longitudinally elongate upper guide slot 111 and at the lower portion of the upper guide slot 111 a lower guide slot 112 which is vertically elongate. An inner side portion 37*b* of the support shaft 37 on the partition plate 20 is movably inserted in the upper guide slot 111 and the support shaft 41 of the pivotable arm 38 is rotatably inserted in the lower guide slot 112.

The cam 35, the pivotable arm 38, the interlocking lateral rod 107, the engagement sector 108 and the longitudinally moving piece 110 form a vertical head actuating mechanism 113 which pivots the head 3 vertically about the support shafts 79.

In the front upper part of the gear case 14, a pair of guide holes 114 are formed on each side. Rotatably supported in the guide holes 114 are disks 116 of a crankshaft 115 each of which has a crank arm 117 projecting outwardly from an eccentric position. The crankshaft 115 has a third interlocking gear 118 rigidly secured to one end portion thereof and in mesh with the second interlocking gear 57. On each side below the crank arm 117, a pair of vertically spaced mounting members 119 are projected. Action plates 120 are mounted to the upper mounting members 119 on each side through their longitudinally elongate guide slots 121 so that they are slidable back and forth along the upper mounting members 119. The action plates 120 have projections 122 each protruding from one side of the upper part thereof. The projections 122 each have a vertically elongate guide slot 123 in which the crank arm 117 is rotatably inserted. The action plates 120 on each side have a pair of engagement pieces 124 on the lower part thereof. Between the upper and lower mounting members 119 on each side a wing mounting frame 125 is so arranged on a vertical shaft 126 that it can be pivoted back and forth. The wing mounting frames 125 each have a vertical engagement rod 127 that is projected inwardly from the frame 125 and rotatably held between the engagement pieces 124. Each of the wing mounting frames 125 also has a mounting piece 128 projecting outwardly, to which a connecting section 129 of the wing frame 5 is secured. The wing frames 5 are embedded in wings 130.

The crankshaft 115, the action plates 120, the wing mounting frames 125, the vertical shafts 126, and the wing frames 5 combine to form a wing actuating mechanism 131 that expands or retracts the wing 130 on each side.

Two opposing support fittings 132 are provided on the battery case 16 at the front and rear portions to securely hold a printed circuit board 133 which contains a voice recording and reproducing device 134 made up of a voice recording circuit and a voice reproducing circuit including an amplifier. A microphone 135 connected to the voice recording circuit is installed in a mounting recess 137 of a chest portion 136 of the body frame 2. A speaker 138 connected to the voice reproducing circuit is secured to a mounting frame 139 installed at the rear lower portion of the battery case 16. The speaker 138 is set in an opening 140 formed in the abdominal portion of the body frame 2. The voice recording circuit is connected to the motor 22 through the motor control circuit to energize the motor for only a specified period of time.

The tail frame 6 is mounted vertically pivotable on a support shaft 141 at the rear end of the body frame 2 so that it extends over and thereby covers the switch knob 19.

Now, we will explain the action of the above embodiment.

When the tail frame 6 is turned up to allow access to the switch knob 19, the upper part of the switch knob 19 is opened and the switch knob 19 is turned from the off position to the on position, the switch mechanism is turned on. But with no voice entered to the microphone 135, the voice recording and reproducing device 134 prevents the motor 22 from being energized and the motor is in a standby condition ready for receiving voice.

Next, when a voice higher than a specified level is uttered toward the toy 1, it enters the microphone 135 at the chest portion 136 of the toy 1 and is recorded in the voice recording circuit. The voice is recorded for a preset recording time of, say, several seconds. As the preset recording time is up, the voice recording circuit is stopped and the voice reproducing circuit is energized. At the same time the motor 22 is also started by the motor control circuit. The voice reproduced by the voice reproducing circuit is generated through the speaker 138 at the abdominal portion of the toy 1. The voice or sound is reproduced by the speaker 138 for the same length of time that it was recorded. Then when the voice reproduction is finished, the voice recording circuit inhibits input of any voice from microphone 135 until the motor 22 comes to a complete stop in order to prevent erroneous operations. Several seconds after the motor 22 has stopped, the microphone 135 returns to the standby mode for receiving a voice.

When the motor 22 is started and operated for a preset time, the operation of the motor 22 rotates the pinion 23, the gear train 29, the intermediate gear 27 and then the rotating member 52. The rotation of the intermediate gear 27 also turns the pinion 30 through the clutch 31 and then the first interlocking gear 56 and the second interlocking gear 57. At the same time the cam drive gear 36 is rotated to turn the cam 35.

As the rotating member 52 is turned, this rotation is transmitted through the output gear 55 of the rotating member 52 and the input gear 84 of the beak actuating mechanism 106 to the interlocking rod 91. The interlocking rod 91 then rotates the cam 97 which in turn moves the interlocking ring 98 and its interlocking piece 99 in the direction perpendicular to the interlocking rod 91. The movement of the interlocking piece 99 is transmitted to the upper and lower beak mounting members 102 through the connecting rod 100, causing the beak mounting members 102 to pivot vertically about the support shafts 103 with the result that the upper and lower beaks 4 mounted to the beak mounting members 102 are also pivoted vertically.

Thus, the toy 1 pivots the upper and lower beaks 4 vertically by the action of the beak actuating mechanism 106 to open and close the opening 101 at the base of the beak. This action is performed for a predetermined period of time.

When the cam 35 is rotated, the pivotable arm 38 of the body pivoting mechanism 46 is pivoted back and forth about the outer portion **37*a* of the support shaft 37 against the force of the coil spring 45. The longitudinal pivoting action of the support shaft 41 of the arm 38 causes the support arm 42 to pivot vertically about the mounting shaft 44. As a result the pivoting action of the arm 38 and the support arm 42 is transformed into the pivoting action of the body frame 2. The body frame 2 then is slowly oscillated back and forth about the cylindrical rod 11 through the bearings 12** on each side.

Figure 8:
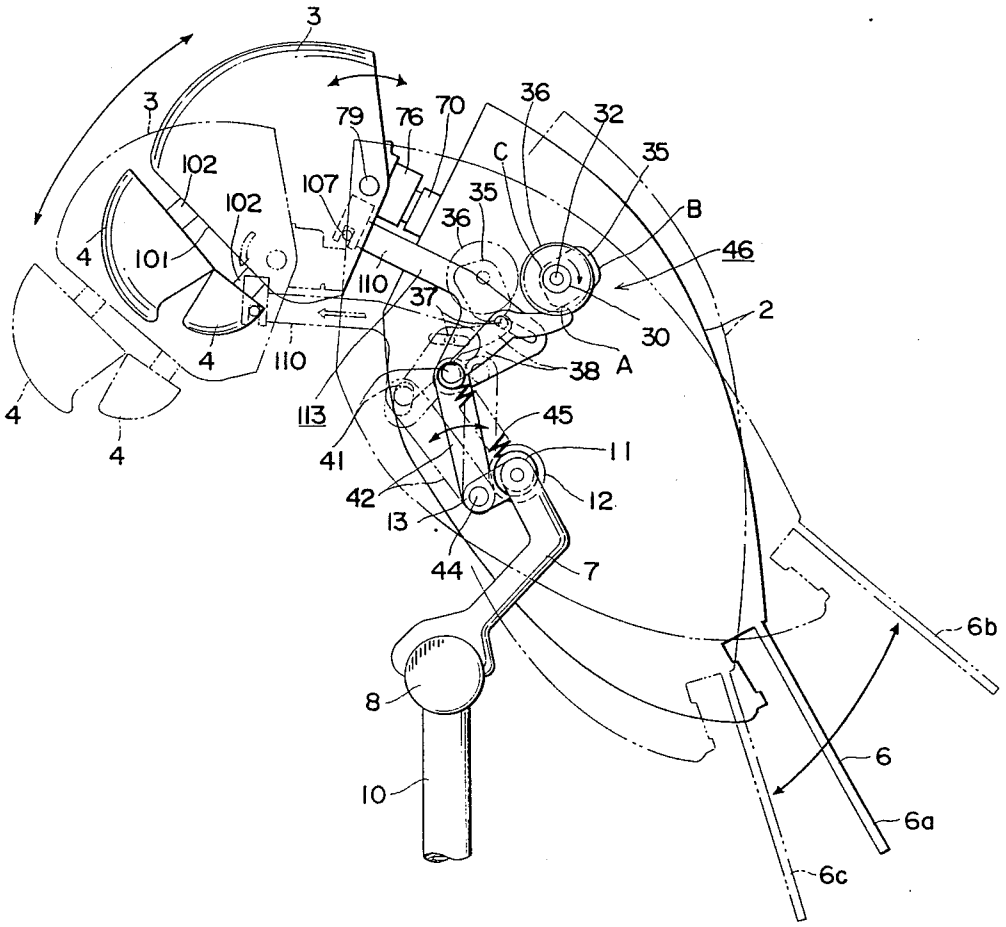
FIG. 8 is a explanatory drawing showing how the toy behaves.
Figure 9:
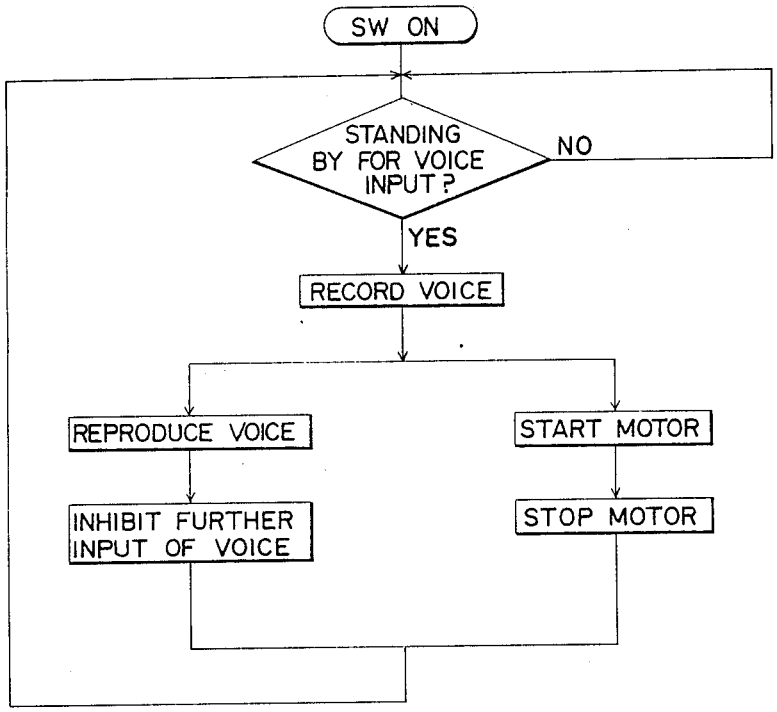
FIG. 9 is an operation flowchart of a voice recording and reproducing device.

Now, let us look at the back-and-forth pivoting action of the body frame 2 in terms of changes in the vertical displacement of the tail frame 6. As shown in FIG. 8, when the engagement portion 40 of pivoting arm 38 engages with the driving surface A of the cam 35, the tail frame 6 assumes the position **6*a* indicated by a solid line of FIG. 8. When the pivoting arm 38 contacts the driving surface B of the cam 35, the tail frame 6 is moved up to assume the upper position 6*b* indicated by a two-dot line. When the engagement portion 40 engages with the driving surface C of the cam 35, the tail frame 6 is moved down to assume the lower position 6*c* indicated by a one-dot line. Thus, the toy 1** repeats this back-and-forth oscillating action on the body for a specified period of time.

At the same time, when the pivotable arm 38 is pivoted and the support shaft 41 is oscillated back and forth, the longitudinally moving plate 110 of the vertical head actuating mechanism 113 is moved back and forth over the span of the upper guide slot 111, guided by the inner portion **37*b* of the support shaft 37 which is inserted in the upper guide slot 111. As a result the engagement sector 108 of the longitudinally moving plate 110 moves the interlocking lateral rod 107 of the head frame 3 back and forth, causing the head frame 3 to slowly oscillate vertically about the support shafts 79 on each side. Since the interlocking rod 91 that supports the head frame 3 has the joint spring 88 and the connecting cylinder 76 of the support frame 75 has the notched recess 81, the vertical oscillation of the head frame 3 by the interlocking rod 91 can be performed smoothly. The head frame 3 is oscillated downward when the body frame 2 is pivoted backward and is oscillated upward when the body frame 2** is oscillated forward, so that the bird face always looks forward.

Then, when the first interlocking gear 56 and the second interlocking gear 57 are rotated, the rotation is transferred to the drive shaft 47 and the cam disk 49 of the head turning mechanism 82. The cam 48 moves the interlocking frame 62 up and down. The vertical shuttle movement of the interlocking frame 62 causes the pinion 60 to turn in the forward and backward directions alternately through the rack 64. The drive gear 61 is also turned in the forward and backward directions alternately at predetermined intervals. As the drive gear 61 rotates, the rotating member 71 whose crown gear 74 is in mesh with the drive gear 61 is turned clockwise and counterclockwise alternately about the interlocking rod 91. Then, the interlocking lateral rod 107 of the head frame 3 is oscillated along the arc groove 109 of the engagement sector 108, with the result that the head frame 3 slowly turns clockwise and counterclockwise alternately about the interlocking rod 91.

The combined motion of the head frame 3—the slow back and forth oscillation about the support shafts 79 on each side by the vertical head actuating mechanism 113 and the slow alternate clockwise and counterclockwise oscillation about the interlocking rod 91 by the head turning mechanism 82—causes the toy to slowly twist its neck sideways while raising or lowering its head frame 3.

In the overall action, the toy 1 slowly pivots its body back and forth while inclining its face up and down, turning it clockwise and counterclockwise alternately and also widely opening and closing its beak, all at the same time. This combined action is repeated for a specified period of time.

Furthermore, when the second interlocking gear 57 is rotated, the rotation is transmitted through the third interlocking gear 118 to the crankshaft 115. The rotation of the crank arms 117 on each side causes the action plates 120 to slide back and forth with respect to the upper mounting members 119 on each side which are inserted in the guide slots 121 of the action plates 120. The sliding motion of the action plates 120 on each side causes the wing mounting frames 125 to be turned back and forth about the vertical shafts 126 through the engagement pieces 124 and the engagement rods 127. The wing frames 5 secured to the wing mounting frames 125 are then oscillated about the vertical shafts 126 to perform the opening and closing action.

Thus, the toy 1 performs a slow opening and closing action of the wings 130 on each side for a predetermined period of time.

As mentioned above, when the motor 22 is started by the voice recording circuit, the toy 1 slowly oscillates its body back and forth while inclining its face up and down, turning it clockwise and counterclockwise alternately and at the same time widely opening and closing its beak. Simultaneously with these actions the toy also repeats the wing opening and closing actions for a specified period of time, reproduces the recorded voice and utters it through the speaker 138 in synchronism with the opening and closing action of the beak.

With the elapse of a specified period of time, the voice reproducing circuit and the power circuit for the motor 22 are automatically deenergized by the control action of the voice recording and reproducing device 134. And the microphone 135 now goes to the standby mode ready for receiving voices.

Effect of the Invention

According to the first embodiment of this invention, the upper and lower beaks are pivoted up and down simultaneously to open the beaks widely. This big opening action of the beak is one of the interesting actions characteristic of the parrot and will make the toy look very much like a mimicking parrot. Another feature of this embodiment is the combined motion of the toy head produced by the head turning mechanism and the vertical head actuating mechanism. That is, the head frame is slowly rotated to turn the face sideways while being pivoted up and down to produce as natural and smooth an action as possible. This head motion is also combined with the beak opening action, giving the toy very interesting overall actions, making it attractive to a user.

The second embodiment of this invention is provided with the voice recording and reproducing device which has a microphone and a speaker. While performing the above-mentioned combined actions and in synchronism with them, the toy reproduces what the player has uttered to it as if it were responding to the player in a way a real parrot mimicks the word he or she uttered.

As mentioned in the foregoing, these two embodiments of the invention can provide a very interesting moving toy.

What is claimed is:

1. A moving animal toy comprising:
   - a body frame having a rod;
   - a head frame including a head support shaft, said head frame mounted on said rod to permit said head frame to pivot up and down about said head support shaft and rotate clockwise and counterclockwise relative to said body frame about said rod, said head frame also having a beak opening, beak support shafts and upper and lower beaks mounted in said beak opening on said beak support shafts for vertical movement in open and closing directions toward and away from each other;
   - a beak actuating mechanism mounted in said head frame for moving said upper and lower beaks in said open and closing directions;
   - a head turning mechanism including a motor installed in said body frame and connected to said head frame to rotate said head frame clockwise and counterclockwise about said rod; and
   - a vertical head actuating mechanism mounted on said body frame to connect said head frame with said motor, which when actuated will pivot said head frame up and down about said head frame support shaft.

2. The moving animal toy according to claim 1 wherein said head turning mechanism comprises:
   - a cam disk connected to be rotated by said motor;
   - a rack and pinion means, said rack connected to be reciprocated by said cam to alternately rotate said pinion clockwise and counterclockwise;
   - a drive gear connected to said pinion for rotation therewith; and
   - a crown gear connected with said head frame and driven by said drive gear.

3. The moving animal toy according to claim 2, wherein said vertical head actuating mechanism comprises a cam driven by said motor, an arm pivotable back and forth by the rotation of said cam, and a longitudinally moving plate connected to said head frame and mounted rotatably on a support shaft of said pivotable arm.

4. The moving animal toy according to claim 1, wherein said vertical head actuating mechanism comprises a cam driven by said motor, an arm pivotable back and forth by the rotation of said cam, and a longitudinally moving plate connected to said head frame and mounted rotatably on a support shaft of said pivotable arm.

5. A moving animal toy comprising:

a pair of legs;

a body frame having a rod, said body pivotally mounted on said legs for back and forth movement relative thereto;

a head frame including a head support shaft, said head frame mounted on said rod to permit said head frame to pivot up and down about said head support shaft and rotate clockwise and counterclockwise relative to said body frame about said rod, said head frame also having a beak opening, beak support shafts, and upper and lower beaks mounted in said beak opening on said beak support shafts for vertical movement in open and closing directions toward and away from each other;

a beak actuating mechanism mounted in said head frame for moving said upper and lower beaks in said open and closing directions;

a head turning mechanism including a motor installed in said body frame and connected to said head frame to rotate said head frame clockwise and counterclockwise about said rod;

a vertical head actuating mechanism mounted on said body frame to connect said head frame with said motor, which when actuated will pivot said head frame up and down about said head frame support shaft;

a body pivoting mechanism connected to be driven by said motor to pivot said body frame back and forth with respect to said pair of legs; and a voice recording and reproducing device installed in said body frame, said device having a microphone and a speaker spaced from each other in said body frame, said device being adapted to record a voice entered from the microphone and then reproduce the recorded voice and at the same time start said motor.

6. The moving animal toy according to claim 5, wherein said body pivoting mechanism comprises a body support rod for supporting rotatably said body frame on said pair of legs, a support arm mounted on said rod for pivotal movement in a vertical direction, a pivotable arm mounted on said support arm so as to be pivoted vertically by the rotation of a cam driven by said motor, and a spring for urging said pivotable arm so as to be brought always into engagement with said cam.

* * * * *